United States Patent [19]

Leclercq et al.

[11] Patent Number: 5,001,313

[45] Date of Patent: Mar. 19, 1991

[54] ROTATING ARC CIRCUIT BREAKER WITH CENTRIFUGAL EXTINGUISHING GAS EFFECT

[75] Inventors: Pierre Leclercq, Moirans; Paul Glenat; Peter Malkin, both of Grenoble, all of France

[73] Assignee: Merlin Gerin, Meylan, France

[21] Appl. No.: 485,549

[22] Filed: Feb. 27, 1990

[30] Foreign Application Priority Data

Feb. 27, 1989 [FR] France ..... 89 02637

[51] Int. Cl.[5] ..... H01H 33/22; H01H 33/18

[52] U.S. Cl. ..... 200/148 B; 200/147 R

[58] Field of Search ..... 200/147 R, 148 R, 148 B

[56] References Cited

U.S. PATENT DOCUMENTS 4,259,556 3/1981 Kii ..... 200/148 B 4,559,425 12/1985 Kirchesch et al. ..... 200/148 R

FOREIGN PATENT DOCUMENTS 724773 9/1942 Fed. Rep. of Germany .

2349224 4/1975 Fed. Rep. of Germany .

2371762 6/1978 France .

2385210 10/1978 France .

2554274 3/1985 France .

*Primary Examiner*—Robert S. Macon

*Attorney, Agent, or Firm*—Parkhurst, Wendel & Rossi

[57] ABSTRACT

A rotating arc circuit breaker comprising a pair of separable arcing contacts, a coil to set the arc in rotation, and an annular migration electrode. Guiding fins are arranged in the extinguishing chamber to slow down the rotation of the gas in a first peripheral zone, so as to generate a differential speed between the arc and the gas favoring the heat exchange in the second zone close to the breaking gap.

9 Claims, 3 Drawing Sheets

ROTATING ARC CIRCUIT BREAKER WITH CENTRIFUGAL EXTINGUISHING GAS EFFECT

BACKGROUND OF THE INVENTION

The invention relates to a rotating arc circuit breaker having a sealed enclosure filled with a high dielectric strength gas, notably sulphur hexafluoride, and housing one or more pole-units, each pole-unit comprising:

an extinguishing chamber having a pair of arcing contacts capable of defining a breaking gap when they separate, magnetic blow-out means, notably a coil, or a permanent magnet designed to create a magnetic arc rotation field, causing the gas to be driven by a centrifugal effect towards the periphery of the chamber, an annular arc migration electrode, guiding fins located in the extinguishing chamber to slow down the rotation movement of the extinguishing gas.

In a rotating arc circuit breaker the centrifugal effect driving the gas towards the periphery of the chamber is capable of creating a depression in the vicinity of the breaking gap. This depression gives rise to a decrease of the gas density which weakens the dielectric withstand in this region. The speed of rotation of the arc is moreover close to the gas driving speed, which prevents any efficient heat exchange between the arc and the gas. This results in an insufficiency of the arc recovery voltage which may prevent the arc from being extinguished when short-circuit currents are broken.

The document FR 2,554,274 describes a rotating arc self-extinguishing expansion circuit breaker having guiding fins located in the extinguishing chamber to slow down the rotation movement of the extinguishing gas heated by the arc to the outflow zone. The fins are fixed on an insulating ring covering the arc migration electrode, i.e. in a region close to the breaking gap. A mixture of hot and cold gases takes place in a zone located away from the breaking gap. Arranging the fins in this way is liable to decrease the performances of the circuit breaker.

The object of the invention consists in improving the dielectric withstand, and the arc recovery voltage in a rotating arc circuit breaker.

SUMMARY OF THE INVENTION

The extinguishing chamber is subdivided into a first peripheral zone, disposed concentrically around a second intercalated zone close to the breaking gap, and the guiding fins are located in the first zone, so as to generate a differential speed between the arc and the gas in the second heat exchange zone.

The first zone housing the fins is separated from the external edge of the electrode by an annular space contained in the second zone. The gas is thus slowed down only by the fins in the first peripheral zone of the extinguishing chamber, but not in the second zone close to the arc.

The fins may be of any shape.

The fins may be inclined, or be in the shape of a blade or screw.

This device can be applied to a circuit breaker with or without gas self-extinguishing expansion.

In the case of a self-extinguishing expansion circuit breaker, the extinguishing chamber comprises a revolution surface sealed off at both ends by a first and a second base-plate. The second zone communicates when separation of the arcing contacts takes place with said enclosure forming an expansion chamber via gas outflow ducts, constituted by the tubular arcing contacts.

BRIEF DESCRIPTION OF THE DRAWINGS

Other advantages and features will become more clearly apparent from the following description of an illustrative embodiment of the invention, given as a non-restrictive example only and represented in the accompanying drawings, in which.

DESCRIPTION OF THE PREFERRED EMBODIMENT

The invention is described as applying to a rotating arc self-extinguishing expansion circuit breaker, but it is clear that it is also applicable to a rotating arc circuit breaker without self-extinguishing expansion.

Figure 1:
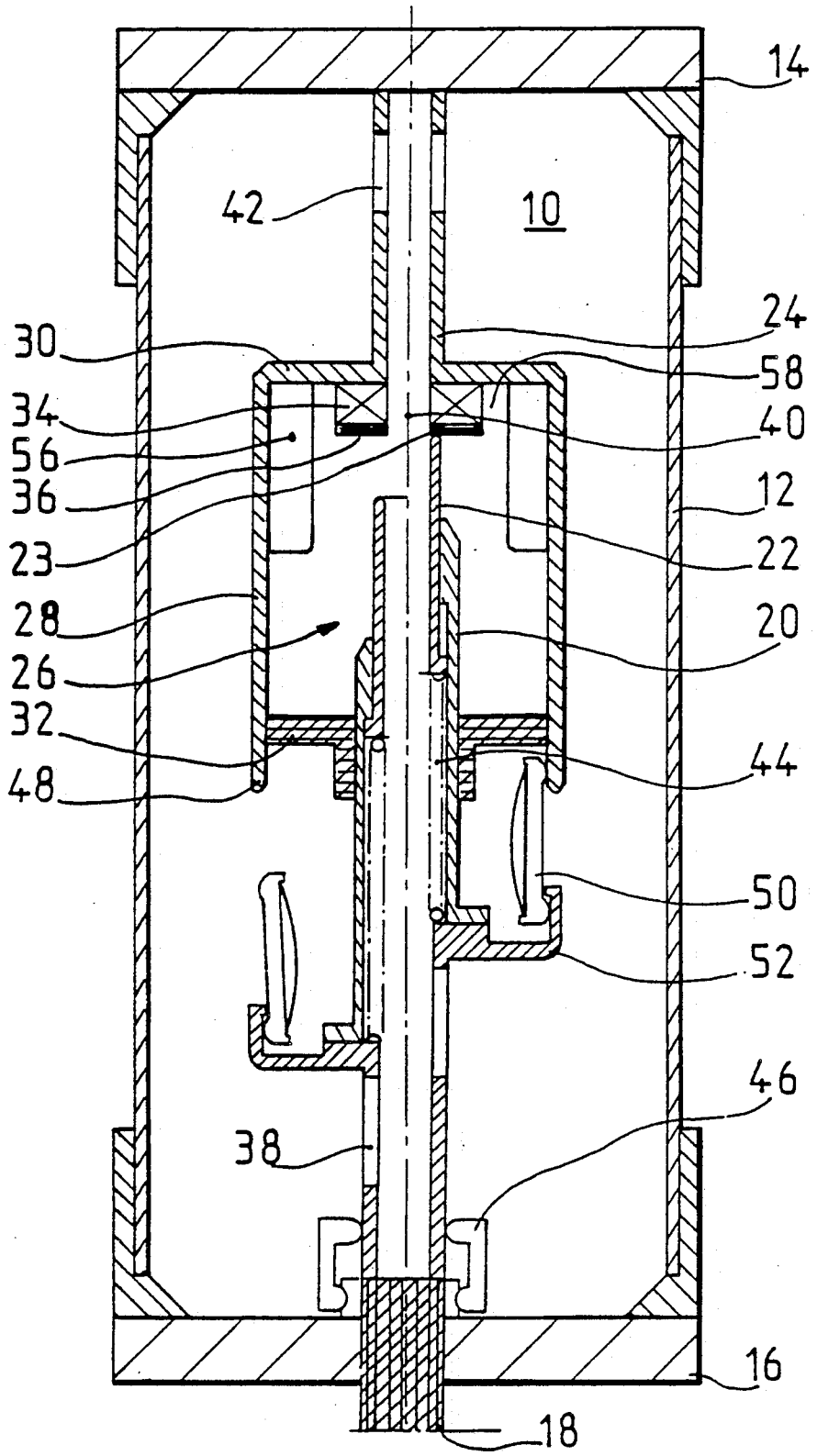
FIG. 1 is a schematic sectional view of a self-extinguishing expansion circuit breaker according to the invention, the left-hand half-view representing the circuit breaker in the open position, and the right-hand half-view in the closed position.

In FIG. 1, a pole-unit of a medium or high voltage circuit breaker or switch is of the type described in the document FR-A-2,617,633. The pole-unit comprises an enclosure 10 confined by a cylindrical casing 12, sealed at its ends by two baseplates 14, 16. The enclosure 10 is filled with a high dielectric strength gas, notably sulphur hexafluoride at atmospheric pressure or overpressure. The cylindrical casing 12 can be made of insulating material and the base-plates 14, 16 of conducting material constituting current input terminal pads. An operating rod 18, arranged in the axis of the enclosure 10, passes tightly through the base-plate 16 and is extended inside the enclosure 10 by a tubular movable contact 20. The tubular movable contact 20 bears at its end a movable arcing contact 22, cooperating with a stationary arcing contact 23 supported by the contact 24 fixed to the opposite base-plate 14. An extinguishing chamber 26, formed by a cylindrical surface 28 and two base-plates 30, 32, surround the contacts 22, 24 coaxially. The cylindrical surface 28 and the base-plate 30 are metallic and electrically connected to the stationary contact part 24. The opposite baseplate 32, through which the movable contact 20 passes, is made of insulating material ensuring electrical insulation between the movable contact 20 and the cylindrical surface 28.

Inside the extinguishing chamber 26 there is located a coil 34 fitted against the metal base-plate 30. The coil 34 is capped by an electrode 36 constituting an arc migration track arranged facing the movable arcing contact 22. The coil 34 is electrically connected both to the electrode 36 and to the baseplate 30 in such a way as to be inserted in series between the movable arcing contact 22 and the stationary contact part 24 in the closed position of the circuit breaker.

In the open position of the circuit breaker represented in the left-hand part of FIG. 1, the extinguishing chamber 26 communicates with the enclosure 10, which constitutes an expansion chamber. Communication is achieved on the one hand by the movable tubular contact 20 whose base has outflow orifices 38 between the tubular inside of the contact 20 and the enclosure 10, and on the other hand by the tubular-shaped stationary contact part 24, which is extended through the coil 34 by a central duct 40 and which communicates at its base by orifices 42 with the enclosure 10. The stationary arcing contact 23 is represented schematically on the internal annular edge of the electrode 36. In the closed position of the circuit breaker, represented in the right-hand half-view of FIG. 1, the movable arcing contact 22 is abutting on the electrode 36 sealing off the two outflow ducts constituted by the contacts 20, 24.

The movable arcing contact 22 is a semi-stationary telescopic contact biased by a spring 44 to the extension position. A sliding contact 46, supported by the base-plate 16 of the enclosure 10, cooperates with the movable contact 20 to ensure the electrical connection of this movable contact 20 and of the current input terminal pad formed by this base-plate 16.

The cylindrical surface 28 of the extinguishing chamber 26 is extended protruding beyond the insulating base-plate 32 by a flange 48 arranged as a stationary main contact. The stationary main contact 48 cooperates with a movable main contact 50 formed by a tulip-finger contact borne by a support 52 securedly united to the movable contact 20. The tulip-shaped contact fingers cooperate with the internal surface of the flange 48 in such a way as to respect the size of the extinguishing chamber 26, but it is clear that a reverse arrangement so as to encompass the flange 48 externally can be used when the dimensions of the main contacts is secondary.

Operation of a switch of this kind is well-known to those specialized in the art, and it is sufficient to recall that opening of the circuit breaker is controlled by downwards sliding in FIG. 1 of the operating rod 18 which drives the tulip-shaped main contact 50 downwards to a separation position of the stationary main contact 48. During the first phase of the circuit breaker opening movement, the telescopically-mounted movable arcing contact 22 remains in abutment on the electrode 36 due to the action of the spring 44. As soon as the main contacts 48, 50 separate, the current is switched to the parallel circuit formed by the movable arcing contact 22 and the coil 34. Opening of the main contacts 48, 50 takes place without an arc forming, and as soon as the current is switched to the parallel circuit, the coil 34 generates a magnetic field which contributes to extinction of the arc forming when the arcing contacts 22, 36 separate in the course of the continued opening movement of the circuit breaker. The arc drawn in the extinguishing chamber 26 causes a heat rise and a pressure increase of the gas contained in this chamber, this gas escaping via the tubular contacts 20, 24 to the expansion chamber constituted by the enclosure 10. This results in a gas outflow which causes the arc to be blown out.

In the example described above, the coil 34 is switched into circuit as soon as the main contacts 48, 50 open, but it is clear that this switching into circuit can be achieved in a different way, notably by switching the arc onto the electrode 36. The coil 34 can also be replaced by a permanent magnet and the gas outflow can take place via one of the contacts only.

According to the invention, a plurality of radial fins 56 are disposed inside the extinguishing chamber 26 along the cylindrical surface 28. The fins 56 are made of conducting or insulating material, and extend radially around the axis remaining separated from the external edge of the electrode 36 and of the coil 34 by an annular space 58.

The extinguishing chamber 26 is subdivided into two concentric zones, comprising a first peripheral zone 60 enclosing the fins 56, and a second intercalated zone 62 arranged between the first zone 60 and the breaking gap. The arc 64 is established in the breaking gap when the arcing contacts 22, 23 separate, and the space 58 is comprised in the second zone 62.

In FIG. 1, the fins 56 are secured to the base-plate 30 and to the cylindrical surface 28, and each has a uniform straight cross-section.

Figure 2:
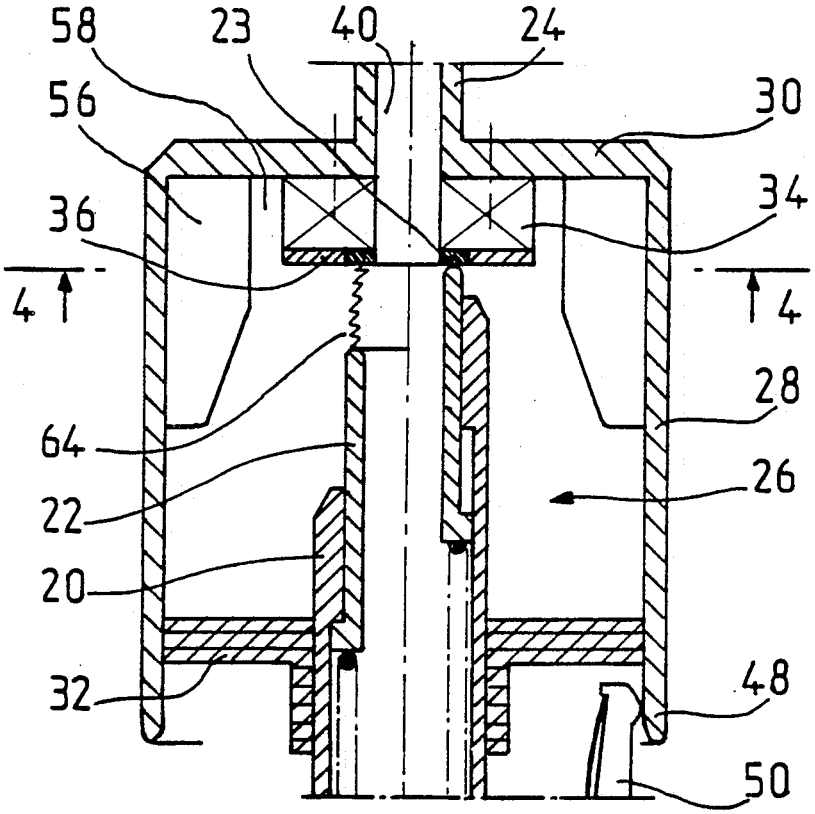
FIG. 2 represents a partial view of FIG. 1, of an alternative embodiment.
Figure 4:
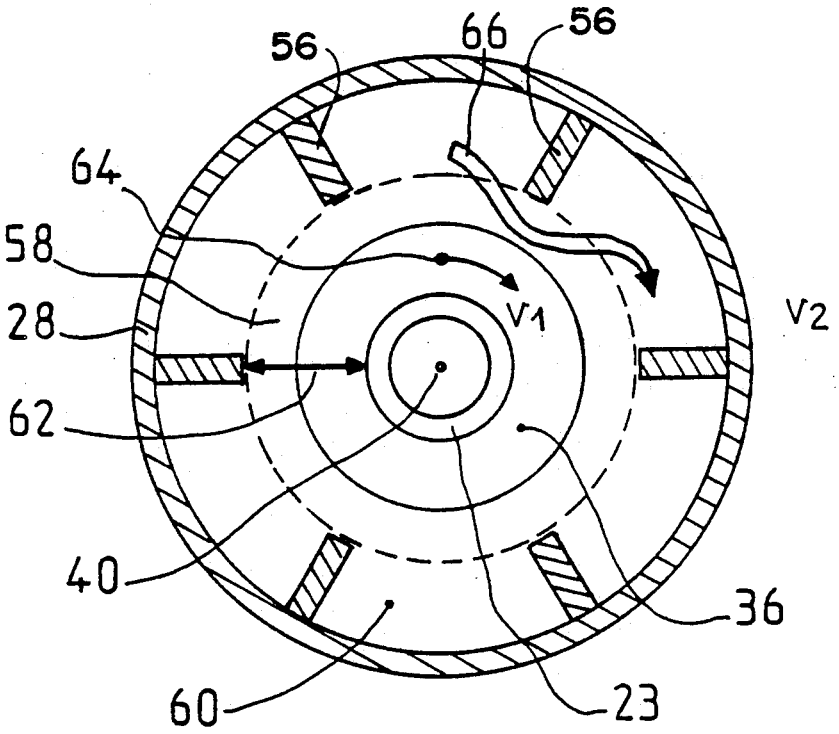
FIG. 4 shows a sectional view along the line 4—4 of FIG. 2.

In the alternative embodiment in FIGS. 2 and 4, the cross-section of each of the six fins is uniform on the base-plate 30 side and around the breaking gap, then decreases progressively up to the middle part of the cylindrical surface 28.

Figure 3:
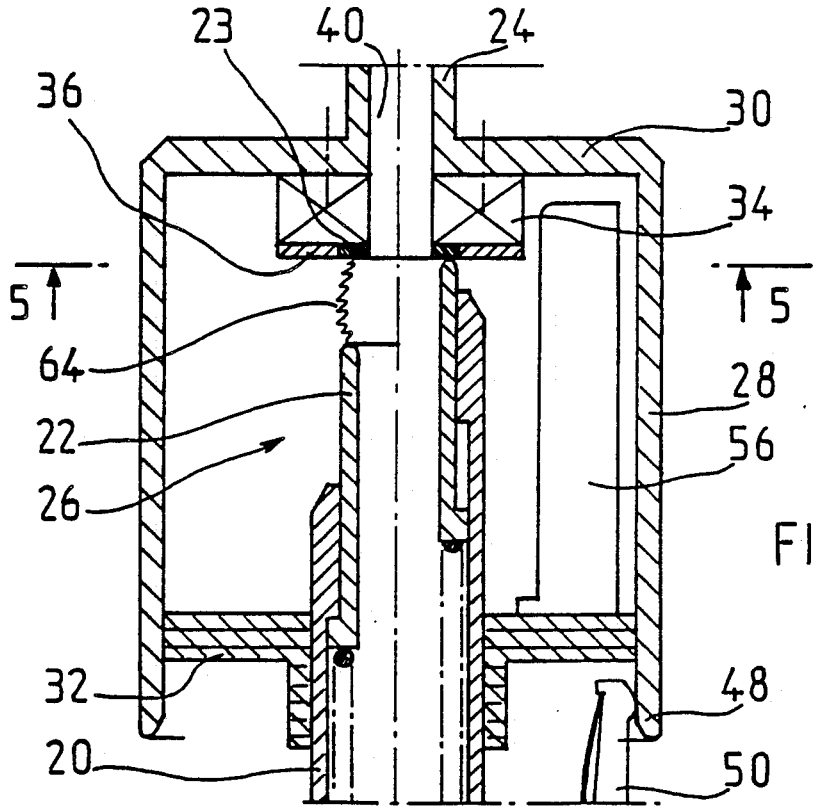
FIG. 3 is an identical view to FIG. 2 of another alternative embodiment.
Figure 5:
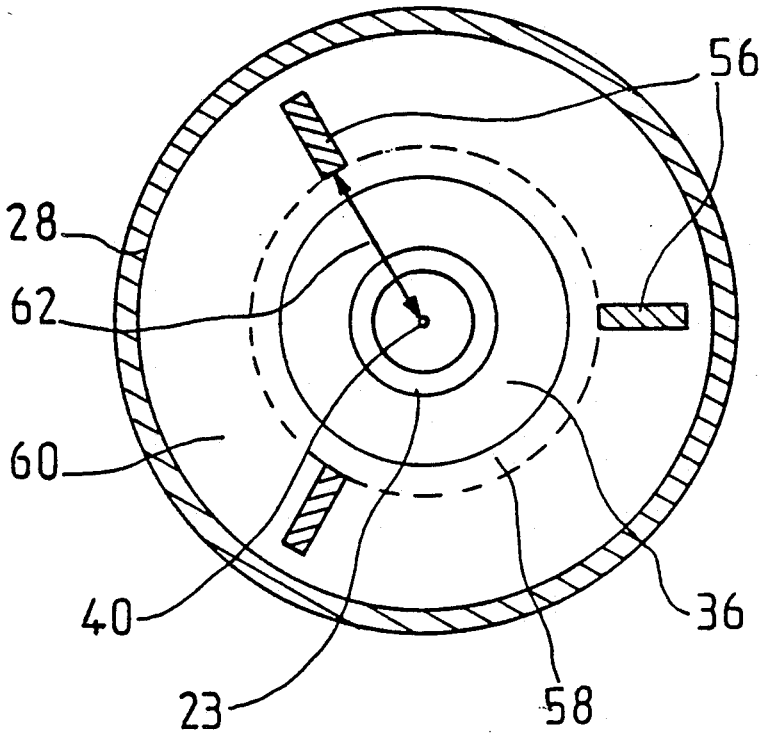
FIG. 5 is a sectional view along the line 5—5 of FIG. 3.

In the other alternative embodiment in FIGS. 3 and 5, the three fins 56 are secured to the opposite insulating base-plate 32, and extend over almost the whole height of the chamber 26, being separated from the cylindrical surface 28 by a small interstice 64, and from the electrode 36 by the space 58.

When separation of the arcing contacts 22, 23 occurs, the arc 64 rotates at high speed on the electrode 36 with a hot gas ring forming in the breaking gap. The heated gas is driven in rotation towards the extinguishing chamber periphery due to the effect of the centrifugal forces generated by the arc rotation. The action of the fins 56 tends to slow down the corresponding gas outflow 66 (see FIG. 4) in the first peripheral zone 60, but not in the second intercalated zone 62. The speed v2 of the gas outflow is then lower than the speed v1 of the arc on the electrode 36, and this results in the second zone 62 in a differential speed between the arc 64 and the gas outflow 66. This differential speed enhances the heat exchange in the zone 62 between the arc and the SF6 gas, and contributes to high-speed extinction of the arc 64.

The fins 56 can also be inclined with respect to the radial direction, or be in the shape of a blade or screw.

We claim:

1. A rotating arc circuit breaker having a sealed enclosure filled with a high dielectric strength gas and housing at least one pole-unit, the pole-unit comprising:

an extinguishing chamber sealed at each opposing end by a base plate;

magnetic means disposed within said chamber at one said end;

an annular arc migration electrode disposed adjacent said magnetic means and defining a first arcing contact within an annulus thereof;

a second arcing contact which communicates with said first contact to induce formation of an arc, when separated from said first contact, in an annular breaking gap zone defined therebetween said second contact constituting gas outflow ducts between said chamber and the enclosure; and fins disposed radially in an outer peripheral annular zone of said chamber, whereby an annular heat exchange zone is defined between said peripheral zone and said breaking gap zone;

wherein said arc is rotated on said electrode by a magnetic field created by said magnetic means and centrifugally drives the gas toward said peripheral zone, whereby a velocity of gas in said peripheral zone is decreased by said fins, which in turn induces a differential velocity between said arc and gas in said heat exchange zone to thereby extinguish said arc.

2. The circuit breaker of claim 1, wherein the gas consists of sulphur hexafluoride.

3. A rotating arc circuit breaker having a sealed enclosure filled with a high dielectric strength gas and housing at least one pole-unit, the pole-unit comprising:

an extinguishing chamber sealed at each opposing end by a base plate;

magnetic means disposed within said chamber at one said end;

an annular arc migration electrode disposed adjacent said magnetic means and defining a first arcing contact within an annulus thereof;

a second arcing contact which communicates with said first contact to induce formation of an arc, when separated from said first contact, in an annular breaking zone defined therebetween, said second contact constituting gas outflow ducts between said chamber and the enclosure; and fins disposed in an outer peripheral annular zone of said chamber and being inclined with respect to a radial direction thereof, whereby an annular heat exchange zone is defined between said peripheral zone and said breaking gap zone;

wherein said arc is rotated on said electrode by a magnetic field created by said magnetic means and centrifugally drives the gas toward said peripheral zone, whereby a velocity of gas in said peripheral zone is decreased by said fins, which in turn induces a differential velocity between said arc and gas in said heat exchange zone to thereby extinguish said arc.

4. The circuit breaker of claim 3, wherein the gas consists of sulphur hexafluoride.

5. A rotating arc circuit breaker having a sealed enclosure filled with a high dielectric strength gas and housing at least one pole-unit, the pole-unit comprising:

an extinguishing chamber sealed at each opposing end by a first base plate and a second base plate, respectively;

magnetic means disposed within said chamber adjacent said first base plate;

an annular arc migration electrode disposed adjacent said magnetic means and defining a first arcing contact within an annulus thereof;

a second arcing contact which communicates with said first contact to induce formation of an arc, when separated from said first contact, in an annular breaking zone defined therebetween, said second contact constituting gas outflow ducts between said chamber and the enclosure; and fins supported by said second base plate in an outer peripheral annular zone of said chamber and extending to a vicinity of said electrode, whereby an annular heat exchange zone is defined between said peripheral zone and said breaking gap zone;

wherein said arc is rotated on said electrode by a magnetic field created by said magnetic means and centrifugally drives the gas toward said peripheral zone, whereby a velocity of gas in said peripheral zone is decreased by said fins, which in turn induces a differential velocity between said arc and gas in said heat exchange zone to thereby extinguish said arc.

6. The circuit breaker of claim 5, wherein the gas consists of sulphur hexafluoride.

7. A rotating arc circuit breaker having a sealed enclosure filled with a high dielectric strength gas and housing at least one pole-unit, the pole-unit comprising:

an extinguishing chamber sealed at each opposing end by a base plate;

magnetic means disposed within said chamber at one said end;

an annular arc migration electrode disposed adjacent said magnetic means and defining a first arcing contact within an annulus thereof;

a second arcing contact which communicates with said first contact to induce formation of an arc, when separated from said first contact, in an annular breaking zone defined therebetween, said second contact constituting gas outflow ducts between said chamber and the enclosure; and fins which contact an inner surface of said chamber at an outer peripheral annular zone thereof, whereby an annular heat exchange zone is defined between said peripheral zone and said breaking gap zone;

wherein said arc is rotated on said electrode by a magnetic field created by said magnetic means and centrifugally drives the gas toward said peripheral zone, whereby a velocity of gas in said peripheral zone is decreased by said fins, which in turn induces a differential velocity between said arc and gas in said heat exchange zone to thereby extinguish said arc.

8. The circuit breaker of claim 15, wherein the gas consists of sulphur hexafluoride.

9. The circuit breaker of claim 15, wherein an annular space is defined between an external edge of said electrode and said peripheral zone.

* * * * *